US010676913B2

(12) United States Patent
Lopez, Jr.

(10) Patent No.: US 10,676,913 B2
(45) Date of Patent: Jun. 9, 2020

(54) DRAIN PIPE GATE

(71) Applicant: Ecolab USA Inc., Saint Paul, MN (US)

(72) Inventor: Raymond S. Lopez, Jr., Los Banos, CA (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/280,333

(22) Filed: Feb. 20, 2019

(65) Prior Publication Data

US 2019/0257069 A1 Aug. 22, 2019

Related U.S. Application Data

(60) Provisional application No. 62/632,763, filed on Feb. 20, 2018.

(51) Int. Cl.
*E03F 7/06* (2006.01)

(52) U.S. Cl.
CPC ..... *E03F 7/06* (2013.01)

(58) Field of Classification Search
CPC . E01F 5/005; E03F 7/06; A01M 29/30; F16K 15/03
See application file for complete search history.

(56) References Cited

U.S. PATENT DOCUMENTS 830,112 A * 9/1906 Tenold ..... B01D 35/147 210/131
928,481 A * 7/1909 Tenold ..... B01D 35/147 210/131
929,514 A * 7/1909 Tenold ..... B01D 35/147 210/131
961,834 A * 6/1910 Barlett ..... E03F 7/06 210/131
1,666,756 A * 4/1928 Sass ..... E03F 7/06 210/131
3,086,655 A * 4/1963 Compton ..... E03F 7/06 210/153
3,118,469 A * 1/1964 Schliesser ..... A01M 29/30 137/527.8
4,356,087 A 10/1982 Miles
(Continued)

FOREIGN PATENT DOCUMENTS

CA 2279723 A1 * 2/2001 ..... E01F 5/005
CA 2825893 A1 * 11/2013 ..... E03F 7/06
(Continued)

OTHER PUBLICATIONS

"International Application Serial No. PCT/US2019/018795, International Search Report dated Apr. 2, 2018", 5 pgs.
(Continued)

*Primary Examiner* — Benjamin F Fiorello
(74) *Attorney, Agent, or Firm* — Schwegman Lundberg & Woessner, P.A.

(57) ABSTRACT

This application provides examples of apparatus and methods for gating off openings of drain pipes and other structures with openings using a gate that is mounted on a hinge so as to avoid catching debris exiting the pipe or other structure. Variations of the types of gate design, mounting, and shape of the pipe or other structure that is gated are provided to demonstrate some of the various embodiments of the present subject matter.

21 Claims, 15 Drawing Sheets

(56) References Cited

U.S. PATENT DOCUMENTS

| | | | | | |
|---|---|---|---|---|---|
| 5,037,542 | A * | 8/1991 | Carroll | E01F 5/005 | 137/527.8 |
| 8,459,298 | B1 * | 6/2013 | Valdez | F16K 15/03 | 137/527.6 |
| 8,496,405 | B1 * | 7/2013 | Kincheloe | E03F 5/0404 | 210/163 |
| 8,870,493 | B2 * | 10/2014 | Haire | E02B 7/20 | 137/527.6 |
| 2005/0092372 | A1 * | 5/2005 | Wade | F16K 15/03 | 137/527.6 |
| 2009/0008588 | A1 * | 1/2009 | Giehl | E03F 7/04 | 251/157 |
| 2009/0279954 | A1 * | 11/2009 | Griffith | E03F 1/00 | 405/125 |
| 2018/0016792 | A1 * | 1/2018 | Valdez | A01M 29/30 | |
| 2018/0363285 | A1 * | 12/2018 | Robinson | E03F 3/046 | |

FOREIGN PATENT DOCUMENTS

| | | | | | |
|---|---|---|---|---|---|
| GB | 261995 | A * | 12/1926 | E03F 7/06 | |
| WO | WO-2011158226 | A1 * | 12/2011 | E03F 7/04 | |
| WO | WO-2019164967 | A1 | 8/2019 | | |

OTHER PUBLICATIONS

"International Application Serial No. PCT/US2019/018795, Written Opinion dated Apr. 2, 2019", 8 pgs.

* cited by examiner

DRAIN PIPE GATE

CROSS-REFERENCE TO RELATED APPLICATION

This patent application claims the benefit of U.S. Provisional Patent Application No. 62/632,763, filed Feb. 20, 2018, entitled "DRAIN PIPE GATE", which is incorporated by reference herein in its entirety.

TECHNICAL FIELD

The present disclosure pertains to methods and apparatus for gating off drain pipes and other structures with openings.

BACKGROUND

Drain pipes and other structures with openings attract small animals because they can serve as places to store nesting material and food collected by the animals. The materials deposited in drain pipes and other open structures can obstruct the openings. In the case of drain pipes, water which would normally flow out and away from a structure will back up and may cause flooding or other damage. Pests such as rodents and birds may also create serious problems for commercial and residential property inhabitants and owners. Uncontrolled, birds will roost or nest in or around man-made structures, such as in food retail and warehouse facilities. They can deface structures causing property and structural damage; create an unsanitary environment with droppings and nesting material; cause food contamination and loss of product; transmit diseases to humans and animals; carry ectoparasites which may bite humans or contaminate food; and cause economic loss due to the need to clean up after them and to repair damage; be a nuisance to employees, retail customers and production. Bird issues can result in damage to business reputation and the loss of business when merchandise and food items become littered with nesting debris and bird droppings, and may even cause operations to shut down for pest bird removal, negatively impacting sales.

There is a need in the art for apparatus and methods which can solve at least some of the foregoing problems associated with unwanted pests.

BRIEF DESCRIPTION OF THE DRAWINGS

The present disclosure is illustrated by way of example and not limitation in the figures of the accompanying drawings, in which like references indicate similar elements and in which.

SUMMARY

The present subject matter provides apparatus and methods for gating off openings of drain pipes and other structures with openings, comprising a gate that is mounted on a hinge so as to avoid catching debris exiting the pipe or other structure. Variations of the types of gate design, mounting, and shape of the pipe or other structure that is gated are provided to demonstrate some of the various embodiments of the present subject matter.

Although demonstrated with examples which vary gate design, mounting, and application, the present gate approach can be employed using a variety of materials, designs, dimensions, mountings, and optional features such as magnetic or friction-based catches. The gate design is demonstrated on drain pipes, but one of skill in the art will understand that the design may be used on other structures such as vents, ductwork, and other structures having openings. Therefore, the examples provided herein are not intended in an exhaustive or exclusive sense.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter provides apparatus and methods for gating off openings of drain pipes and other structures with openings, comprising a gate that is mounted on a hinge so as to avoid catching debris exiting the pipe or other structure. Variations of the types of gate design, mounting, and shape of the pipe or other structure that is gated are provided to demonstrate some of the various embodiments of the present subject matter.

Figure 1:
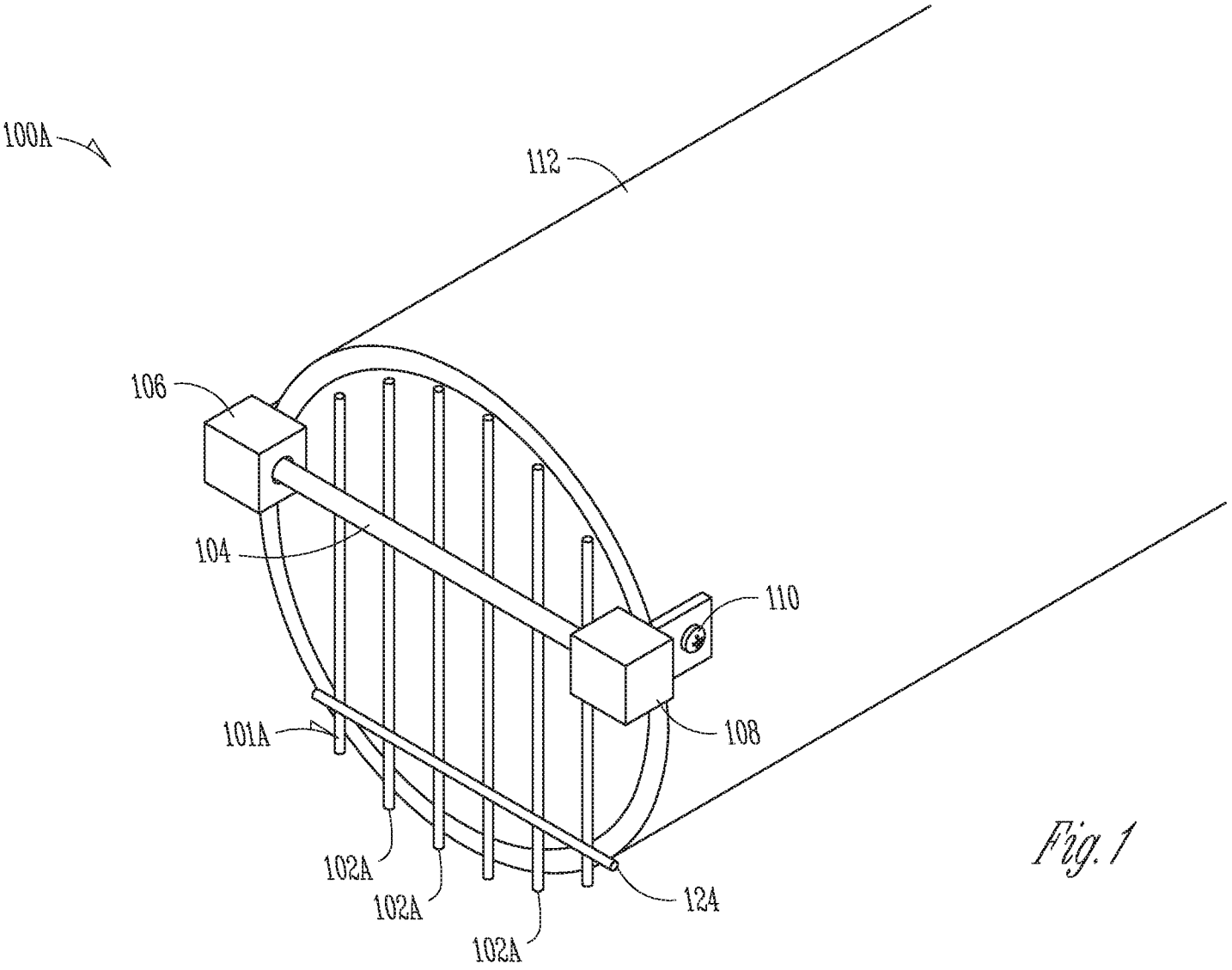
FIG. 1 illustrates a perspective view of a circular drain pipe having a flat gate mounted using two brackets, according to some embodiments of the present subject matter.

FIG. 1 illustrates a perspective view of a circular drain pipe having a flat gate mounted using two brackets, according to some embodiments of the present subject matter. The assembly 100A has a gate 101A and a pipe 112 as shown. Gate 101A has bars 102A and 124 which form a grid that can be used to keep animals, such as squirrels, mice, birds, and other pests, out of the pipe 112 when gate 101A is closed. Gate 101A includes a rod 104 that serves as a hinge with mounts 106 and 108, which are screwed onto the pipe 112 using screws 110. It is understood that other mounts may be used without departing from the scope of the present subject matter. The mounts 106 and 108 work with rod 104 to allow the gate 101A to swing from a normally closed position to an open position to allow fluid and debris to exit the pipe 112. In some embodiments, rod 104 is fixedly connected to the gate 101A, and rotates as the gate 101A rotates. Other ways may be employed to allow the gate 101A to swing from a normally closed position to an open position to allow fluid and debris to exit the pipe 112. For example, the rod 104 may be loosely coupled to the gate 101A to allow the gate 101A to swivel about the rod 104. In various embodiments, the gate 101A is sized to allow the gate to swivel open in the pipe 112 opening. Therefore, a variety of mounts, rods and gate structures 101A may be employed without departing from the scope of the present subject matter.

In various embodiments, mounts 106 and 108 are mounted above the halfway point of pipe 112 to allow for easier passage of liquid and debris from the pipe 112. For example, if sticks or leaves are being washed out of pipe 112 a higher position of the rod 104 accommodates passage of the material from the pipe 112 and also does not obstruct material at the exit of the pipe 112.

In various embodiments, different material may be used in constructing gate 101A. For example, bars 102A and 124 may be made of metal or plastic or any other material that can prevent animals from entering the pipe 112 in a closed state. In various embodiments, combinations of materials can be used to form the gate 101A. For example, gate 101A may be made by cutting a grid of existing metal material, such as fence material or shelving material. Gate 101A may be made of individual wires or bars which are soldered, welded, woven, or otherwise connected together to form gate 101A. Gate 101A may be made of wires or bars which are coated and/or rust proofed to prevent corrosion. Therefore, a variety of materials and construction methods may be used without departing from the scope of the present subject matter.

Gate 101A may be custom made to fit a pipe opening or other structure opening. It is further understood that gate 101A may be made to accommodate standard drain pipe dimensions. It is further understood that gate 101A may be made to accommodate standard vent dimensions.

In various embodiments bar 124 is made of a slightly heavier material to facilitate closure of the gate 101A. In various embodiments, a magnetic catch is used at the bottom of gate 101A to facilitate closing of the gate 101A. In such embodiments, the magnetic catch is connected to the bottom of the gate 101A. If the pipe 112 is metal and magnetic in nature, a second component of the catch may be optional. In applications where pipe 112 is plastic or some other non-ferrous material a second portion of the magnetic catch may be mounted on or under the pipe to facilitate magnetic closure of the gate 101A. The magnetic catch is optional and should be designed to provide only enough force to close the gate, but to allow the gate to open when material and fluid are flowing out of the pipe. Of course, if only fluid is flowing from the exit of the pipe the gate 101A may remain closed and merely allow the fluid to pass without opening. Once debris backs up on the gate 101A, the pipe gate 101A can open long enough to allow the material to pass out of the gate and then close to prevent animals from entering the pipe. In various embodiments, a mechanical catch is used at the bottom of gate 101A. For example, a friction fit may be used to facilitate catching of the bottom of the gate 101A to avoid it swinging in the wind and to ensure its opening is the result of force from the material and fluid exiting pipe 112. Therefore, a variety of materials and configurations may be employed depending on the application and use of gate 101A.

Figure 2:
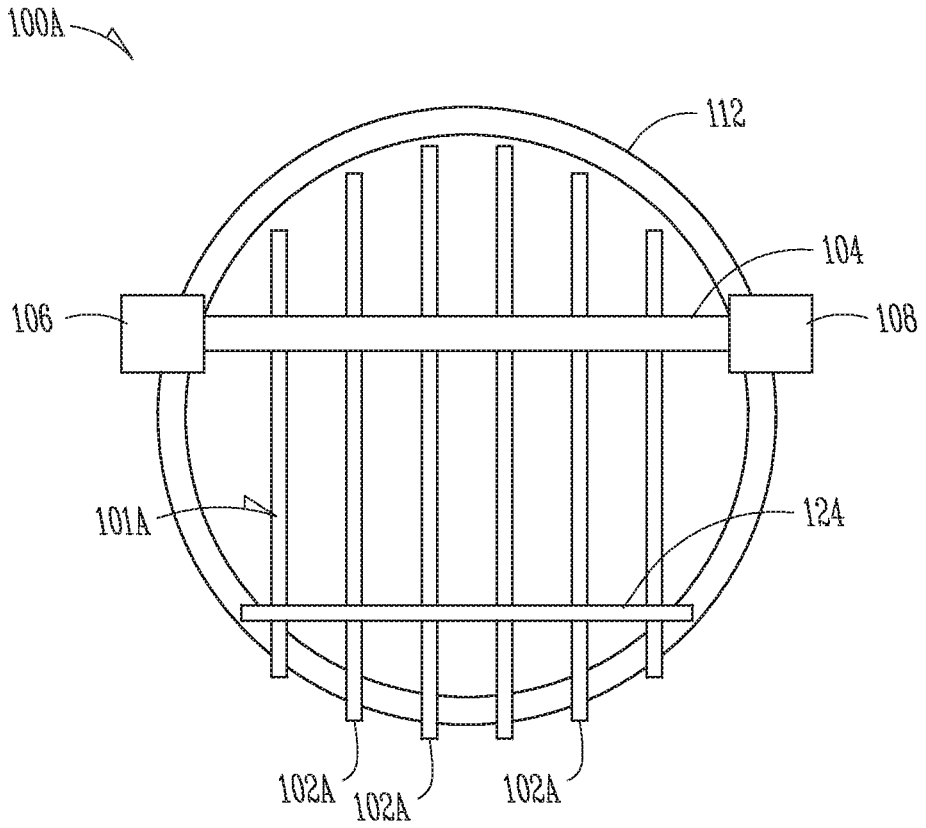
FIG. 2 illustrates an end view of the gate of FIG. 1 in a closed position in accordance with some embodiments of the present subject matter.
Figure 3:
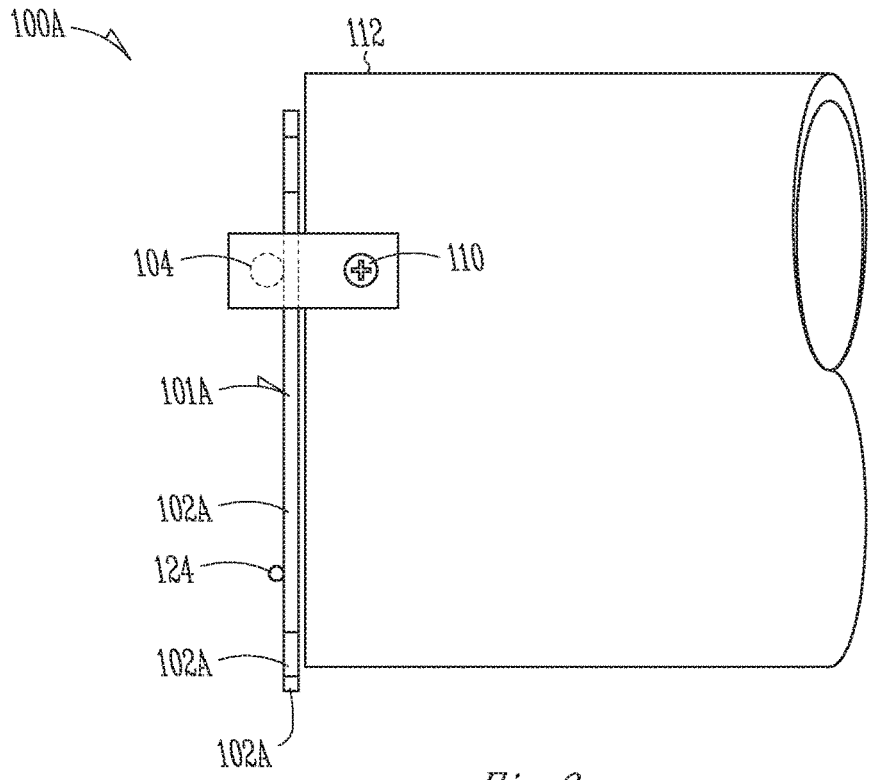
FIG. 3 illustrates a side view of the gate of FIG. 1 in a closed position, in accordance with some embodiments of the present subject matter.

FIG. 2 illustrates an end view of the gate of FIG. 1 in a closed position in accordance with some embodiments of the present subject matter. FIG. 3 illustrates a side view of the gate of FIG. 1 in a closed position, in accordance with some embodiments of the present subject matter. It is understood that screws 110 may be used to secure brackets 106 and 108 to the pipe. Other ways to secure the brackets 106 and 108 may be employed. For example, in various embodiments, rivets or nuts and bolts may be employed. In various embodiments, adhesives may be employed. In such embodiments, it is preferred if the mounting hardware does not obstruct the opening of the pipe 112 or provide an edge that catches material exiting the pipe 112, so as to allow for free passage of the material from the pipe 112. Other means for securing the brackets may be used without departing from the scope of the present subject matter.

Figure 4:
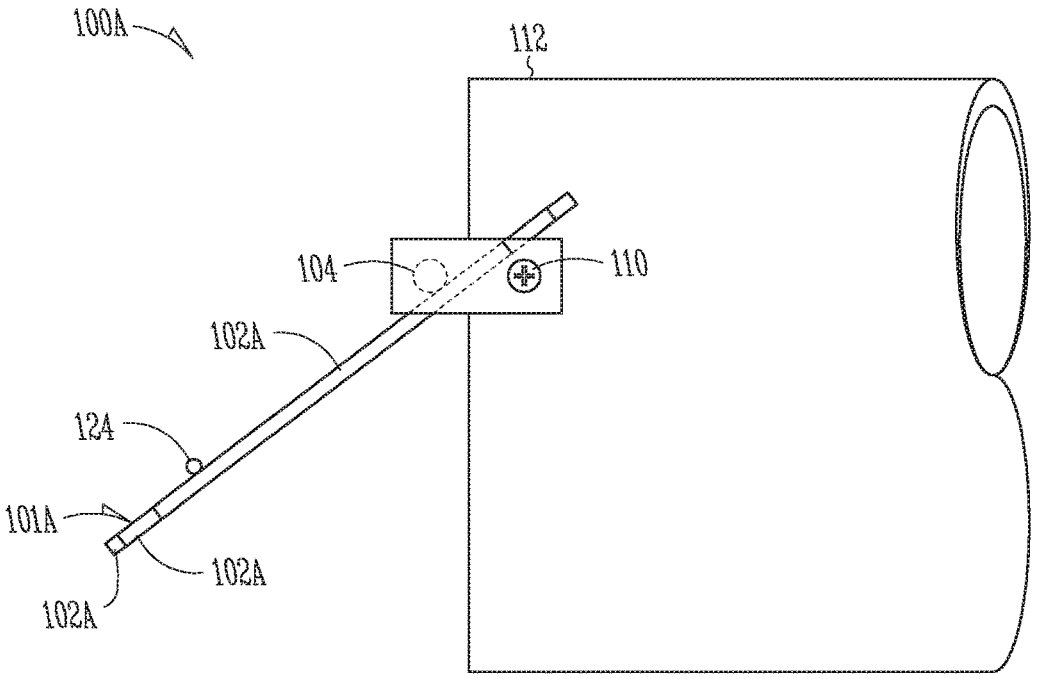
FIG. 4 illustrates a side view of the gate of FIG. 1 in an open position, in accordance with some embodiments of the present subject matter.

FIG. 4 illustrates a side view of the gate of FIG. 1 in an open position, in accordance with some embodiments of the present subject matter. In various embodiments, the gate 101A is able to swing freely to allow material to exit the pipe, and then return to its closed state to prevent pests from entering the pipe 112.

Figure 5:
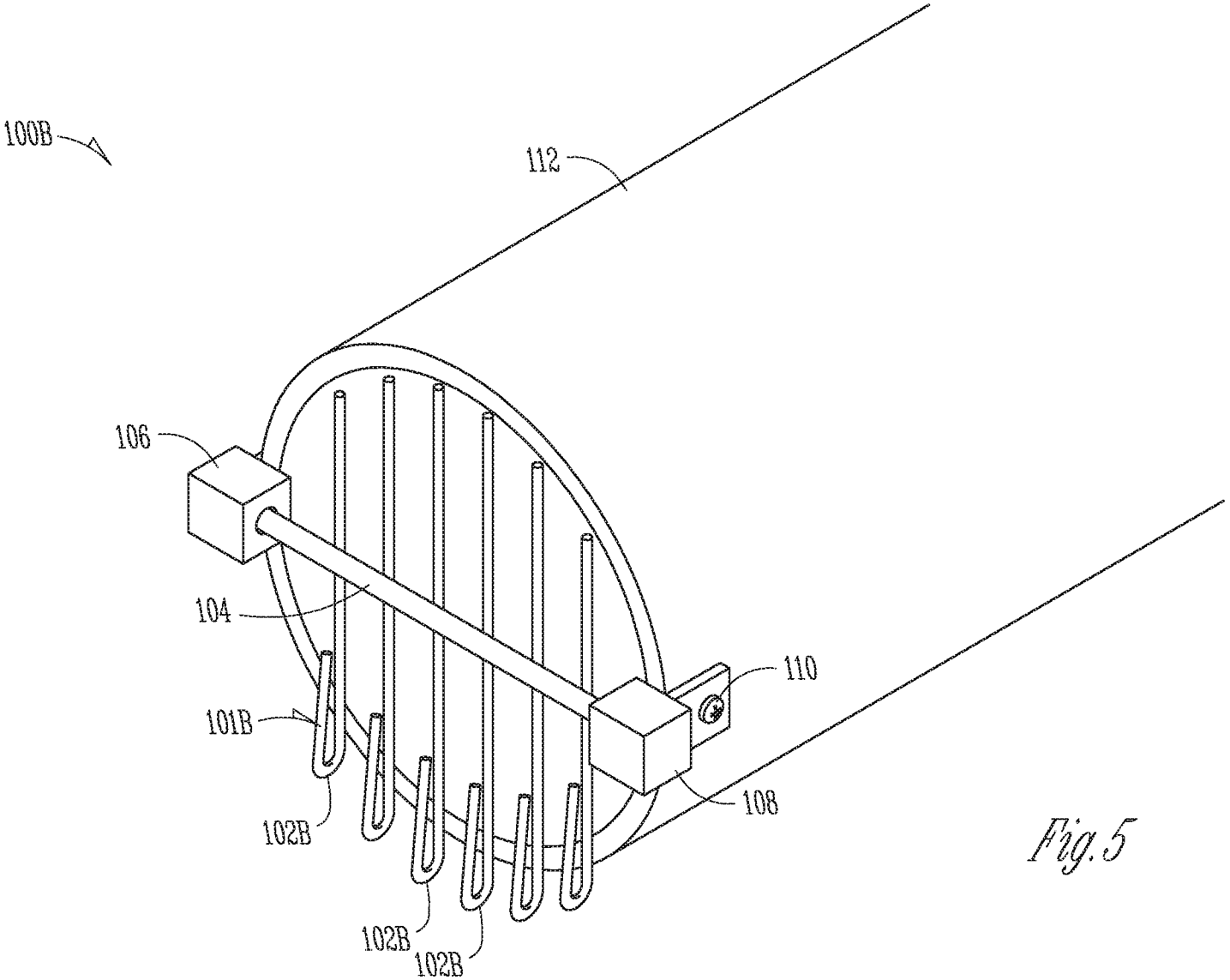
FIG. 5 illustrates a perspective view of a circular drain pipe having a gate with additional weighting near the bottom of the gate and mounted using two brackets, according to some embodiments of the present subject matter.
Figure 6:
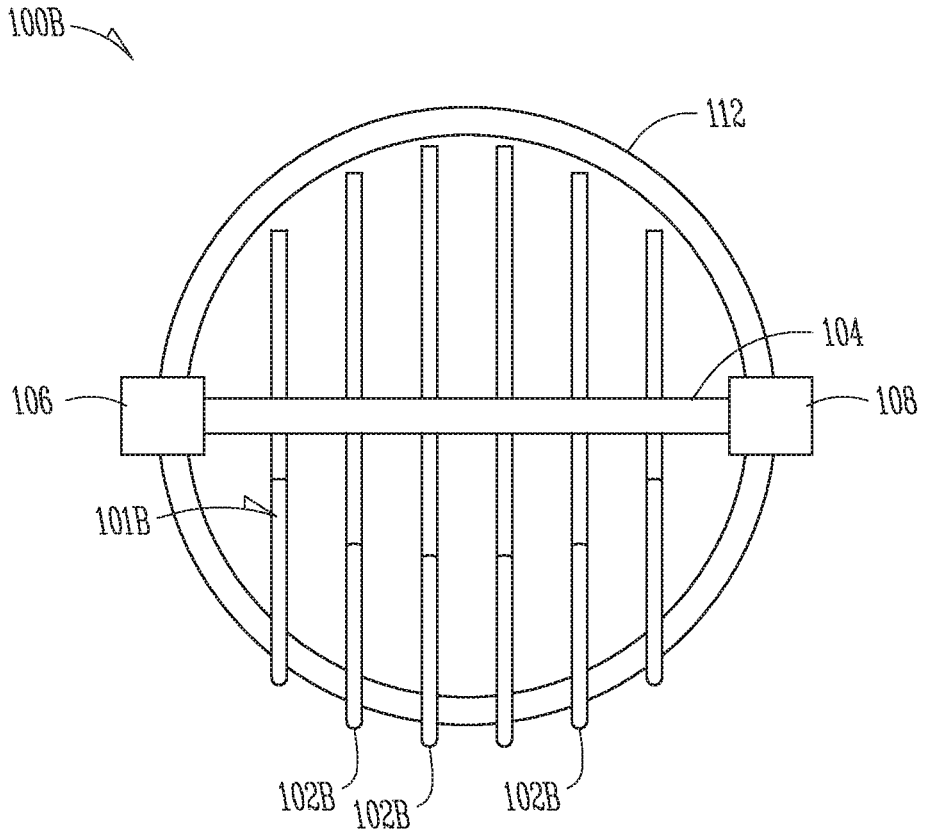
FIG. 6 illustrates an end view of the gate of FIG. 5 in a closed position in accordance with some embodiments of the present subject matter.
Figure 7:
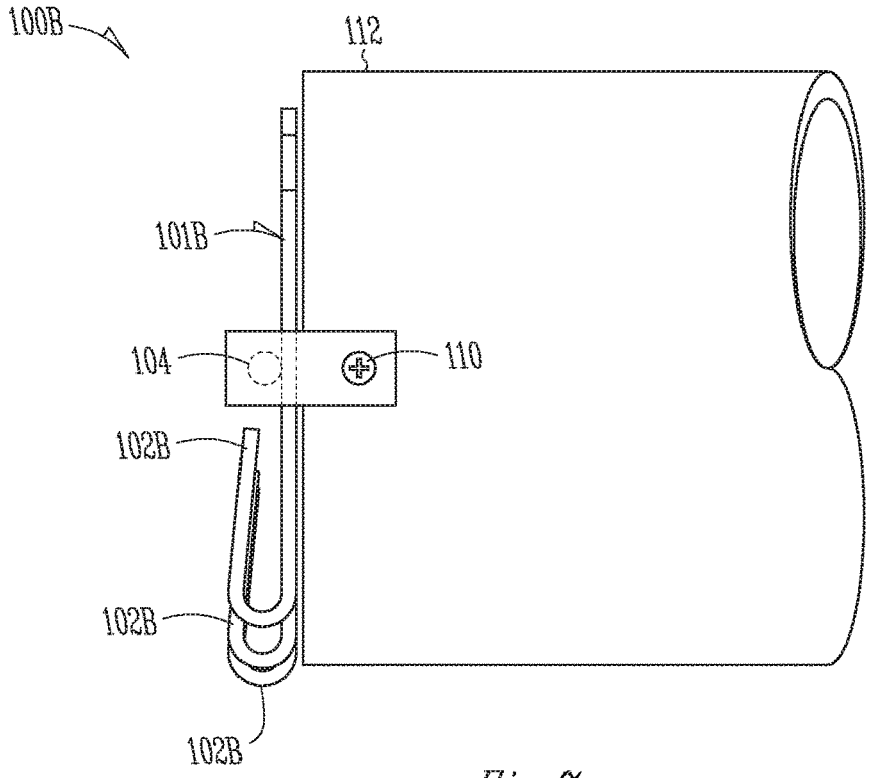
FIG. 7 illustrates a side view of the gate of FIG. 5 in a closed position, in accordance with some embodiments of the present subject matter.
Figure 8:
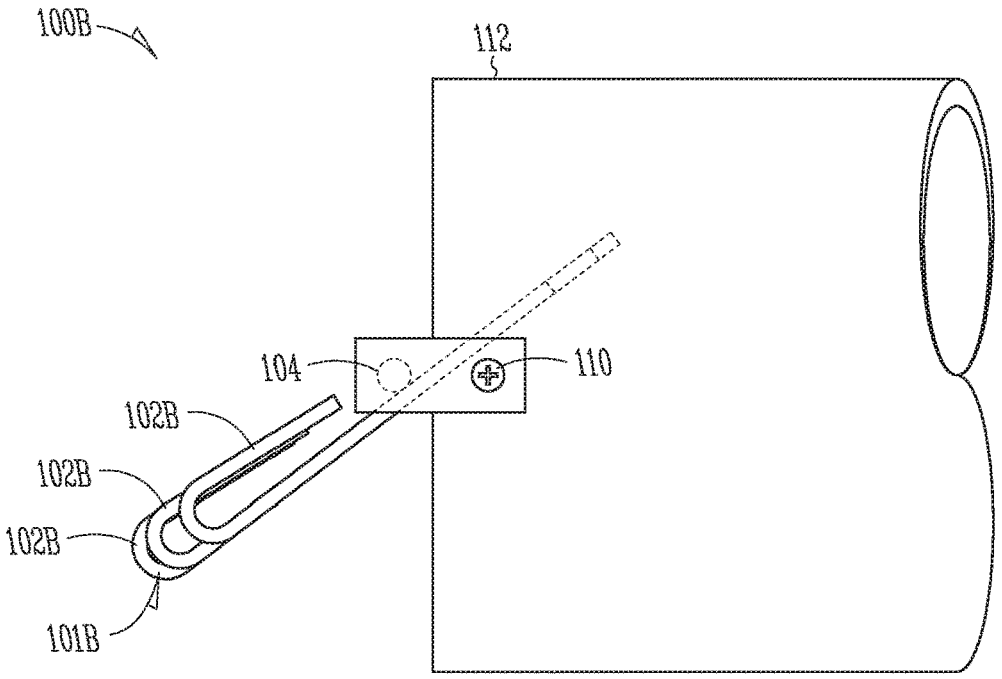
FIG. 8 illustrates a side view of the gate of FIG. 5 in an open position, in accordance with some embodiments of the present subject matter.

FIG. 5 illustrates a perspective view of a circular drain pipe 112 having a gate 101B with additional weighting near the bottom of the gate and mounted using the rod 104 and the two brackets 106 and 108, according to some embodiments of the present subject matter. In this example of an assembly 100B, bars 102B of gate 101B are bent over to provide additional weight at the bottom of the gate 101B to facilitate closure. FIG. 6 illustrates an end view of the gate of FIG. 5 in a closed position in accordance with some embodiments of the present subject matter. FIG. 7 illustrates a side view of the gate of FIG. 5 in a closed position, in accordance with some embodiments of the present subject matter. FIG. 8 illustrates a side view of the gate of FIG. 5 in an open position, in accordance with some embodiments of the present subject matter. The same mechanical and structural considerations apply to gate 101B as set forth above for gate 101A.

Figure 9:
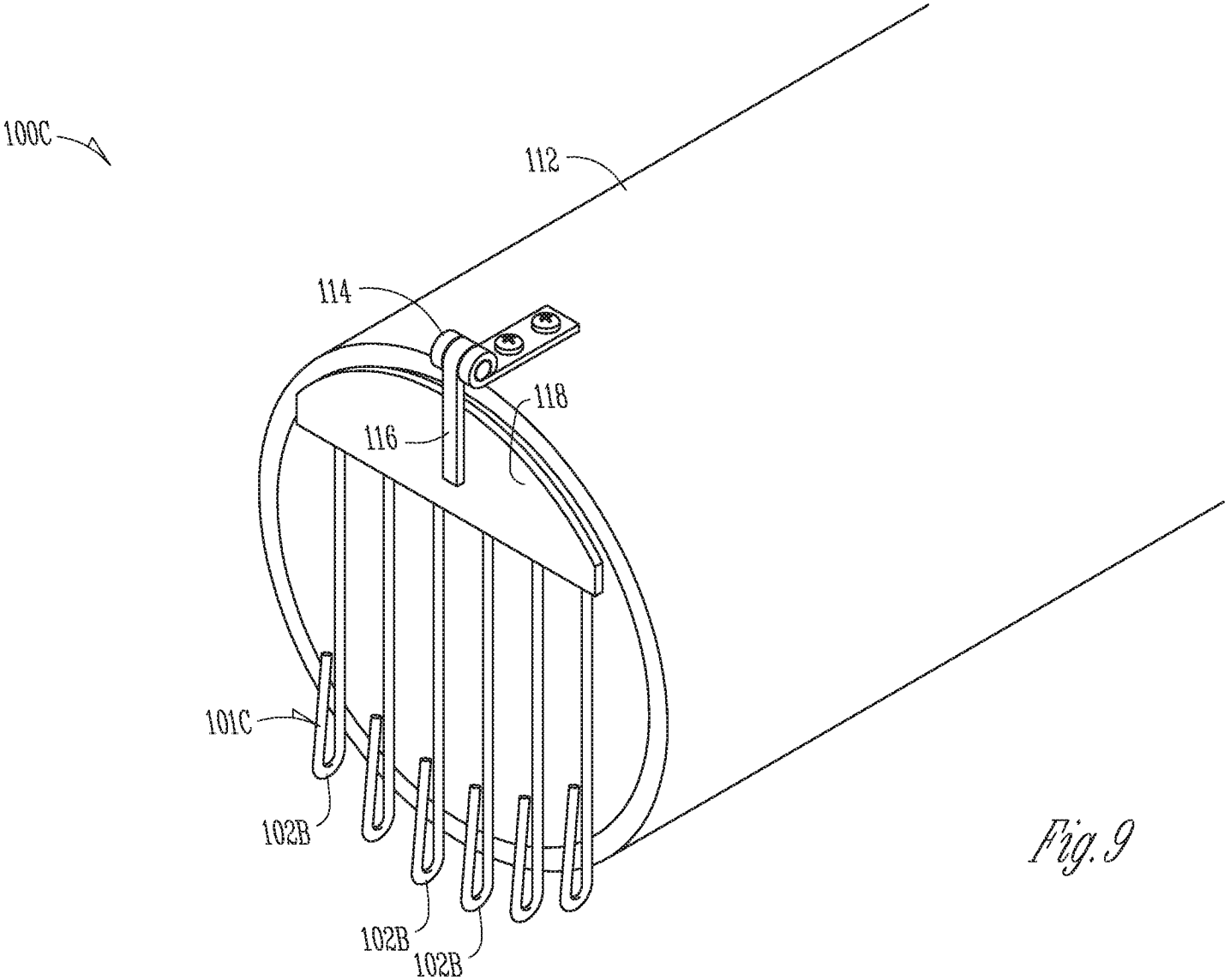
FIG. 9 illustrates a perspective view of a circular drain pipe having a gate mounted using a hinge and plate near the top of the gate and with additional weighting near the bottom of the gate, according to some embodiments of the present subject matter.

FIG. 9 illustrates a perspective view of a circular drain pipe having a gate 101C mounted using a hinge 116 connected to the top of the pipe 112 and to the plate 118 near the top of the gate 101C and with additional weighting near the bottom of the gate, according to some embodiments of the present subject matter. The hinge rotates on rod 114.

Gate 101C has bars 102B which form a grid that can be used to keep animals, such as squirrels, mice, birds, and other pests, out of the pipe 112 when gate 101A is closed. Gate 101C includes a rod 114 that works with the hinge 116 which is screwed onto the pipe 112. It is understood that other mounting methods may be used without departing from the scope of the present subject matter. The hinge 116 allows the gate 101C to swing from a normally closed position to an open position to allow fluid and debris to exit the pipe 112. In some embodiments, plate 118 provides a rigid platform for the hinge 116 to mount to gate 101C and to mount bars 102B. In various embodiments, the gate 101C is sized to allow the gate to swivel open in the pipe 112 opening and to contact the bottom of pipe 112 to prevent animals from pushing their way into pipe 112. A variety of mounts, rods and gate structures 101C may be employed without departing from the scope of the present subject matter.

In various embodiments, hinge 116 is mounted at the top of pipe 112 to allow for easier passage of liquid and debris from the pipe 112. For example, if sticks or leaves are being washed out of pipe 112 the high position of the hinge 116 accommodates passage of the material from the pipe 112 and also does not obstruct material at the exit of the pipe 112.

In various embodiments, different material may be used in constructing gate 101C. For example, bars 102B may be made of metal or plastic or any other material that can prevent animals from entering the pipe 112 in a closed state. In various embodiments, combinations of materials can be used to form the gate 101C. For example, gate 101C may be made by cutting a grid of existing metal material, such as fence material or shelving material. Gate 101C may be made of individual wires or bars which are soldered, welded, woven, or otherwise connected together to form gate 101C. Gate 101C may be made of wires or bars which are coated and/or rust proofed to prevent corrosion. Therefore, a variety of materials and construction methods may be used without departing from the scope of the present subject matter.

Gate 101C may be custom made to fit a pipe opening or other structure opening. It is further understood that gate 101C may be made to accommodate standard drain pipe dimensions. It is further understood that gate 101C may be made to accommodate standard vent dimensions.

In various embodiments a bar is connected to the bottom of gate 101C. In various embodiments, the bar is made of a slightly heavier material than the other material of the gate to facilitate closure of the gate 101C. In various embodiments, a magnetic catch is used at the bottom of gate 101C to facilitate closing of the gate 101C. In such embodiments, the magnetic catch is connected to the bottom of the gate 101C. If the pipe 112 is metal and magnetic in nature, a second component of the catch may be optional. In applications where pipe 112 is plastic or some other non-ferrous material a second portion of the magnetic catch may be mounted on or under the pipe to facilitate magnetic closure of the gate 101C. The magnetic catch is optional and should be designed to provide only enough force to close the gate, but to allow the gate to open when material and fluid are flowing out of the pipe. Of course, if only fluid is flowing from the exit of the pipe the gate 101*c* may remain closed and merely allow the fluid to pass without opening. Once debris backs up on the gate 101C, the pipe gate 101C can open long enough to allow the material to pass out of the gate and then close to prevent animals from entering the pipe. In various embodiments, a mechanical catch is used at the bottom of gate 101C. For example, a friction fit may be used to facilitate catching of the bottom of the gate 101C to avoid it swinging in the wind and to ensure its opening is the result of force from the material and fluid exiting pipe 112. Although FIG. 9 demonstrates screws to hold the hinge 116 to the top of the pipe, it is understood that other mounting hardware may be used without departing from the scope of the present subject matter. For example rivets, bolts, or adhesives may be employed. In such embodiments, it is preferred if the mounting does not obstruct the opening of the pipe 112 or provide an edge that catches material exiting the pipe 112, so as to allow for free passage of the material from the pipe 112. Other means for securing the mounts may be used without departing from the scope of the present subject matter. Therefore, a variety of materials and configurations may be employed depending on the application and use of gate 101C.

Figure 10:
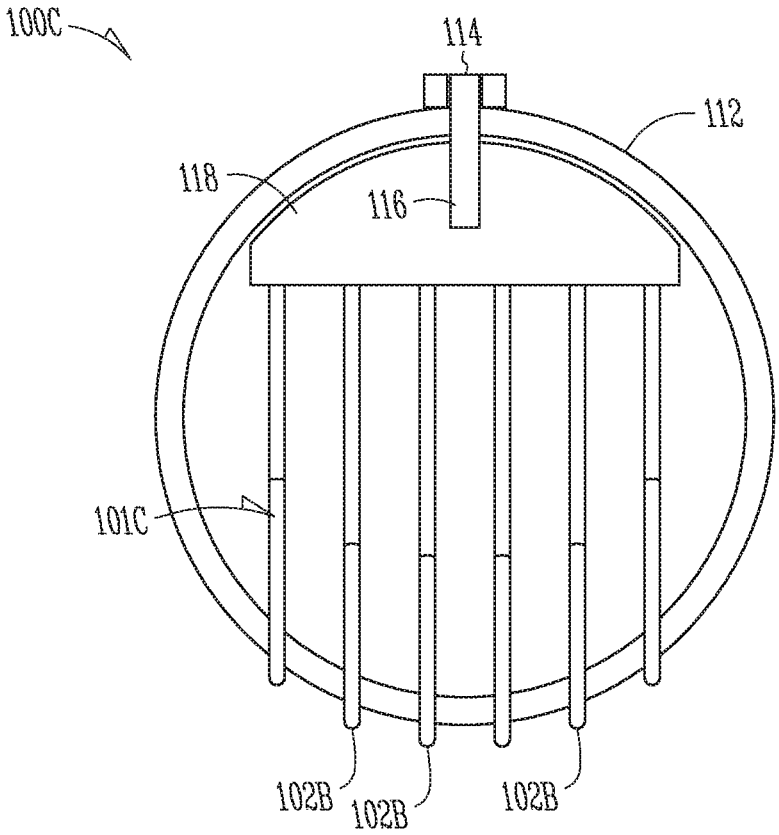
FIG. 10 illustrates an end view of the gate of FIG. 9 in a closed position in accordance with some embodiments of the present subject matter.
Figure 11:
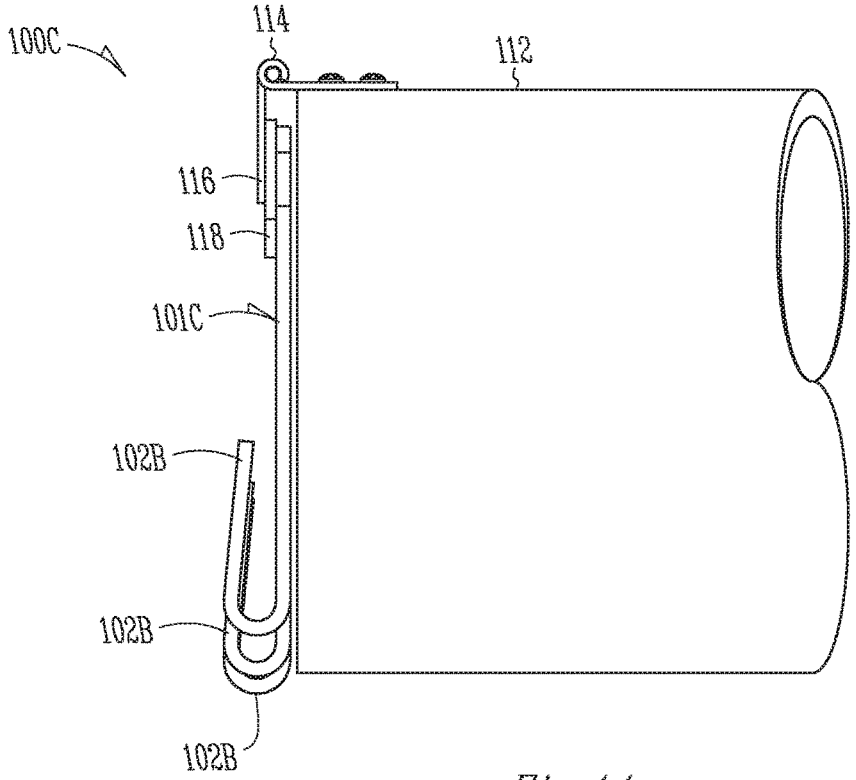
FIG. 11 illustrates a side view of the gate of FIG. 9 in a closed position, in accordance with some embodiments of the present subject matter.
Figure 12:
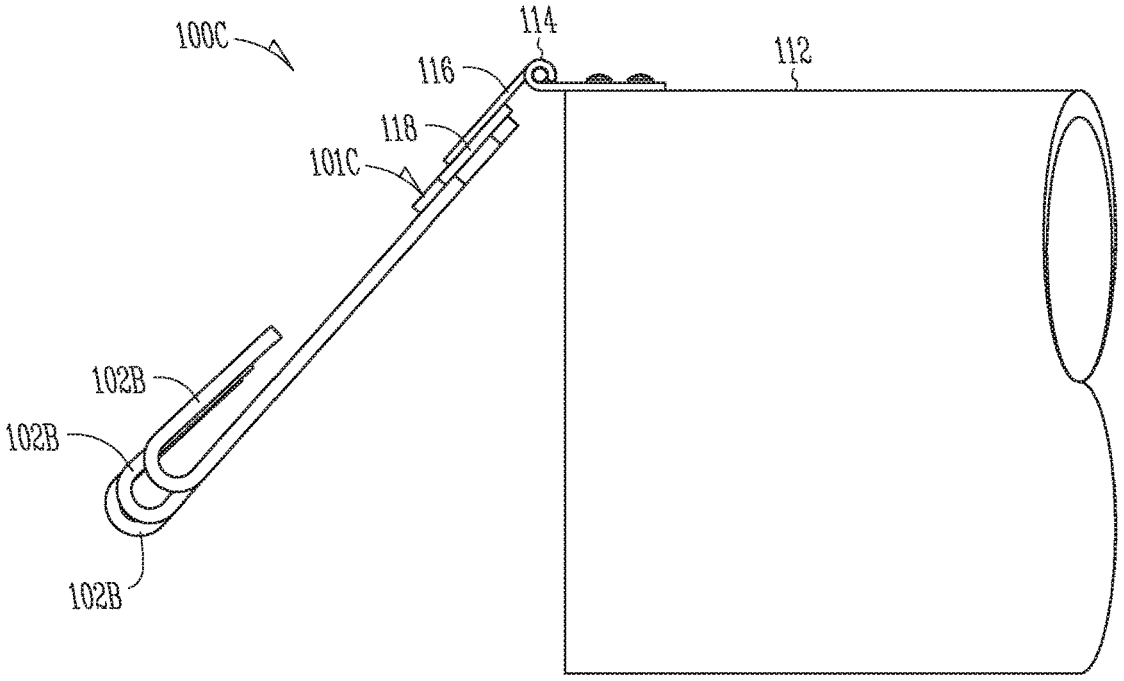
FIG. 12 illustrates a side view of the gate of FIG. 9 in an open position, in accordance with some embodiments of the present subject matter.
Figure 13:
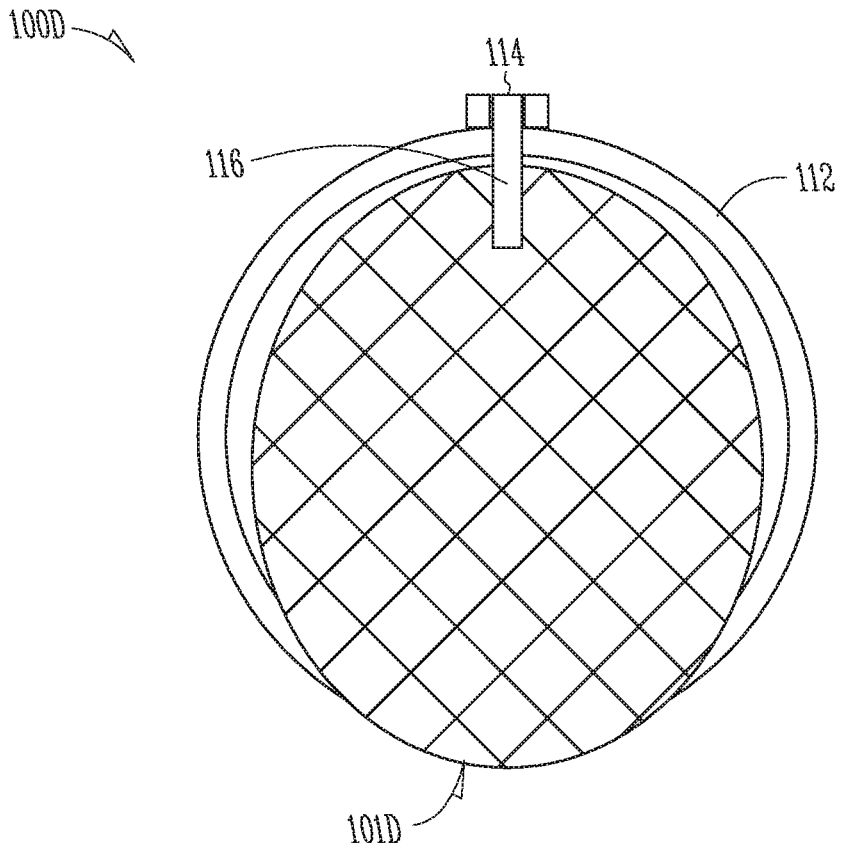
FIG. 13 illustrates an end view of a gate having a screen or mesh, in accordance with some embodiments of the present subject matter.
Figure 14:
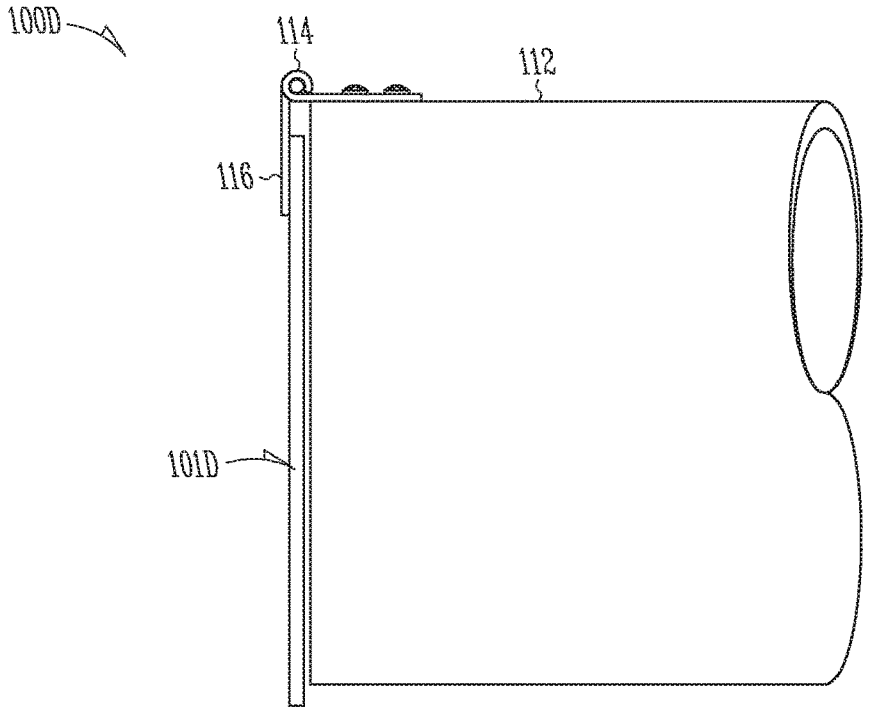
FIG. 14 illustrates a side view of the gate of FIG. 13 in a closed position, in accordance with some embodiments of the present subject matter.
Figure 15:
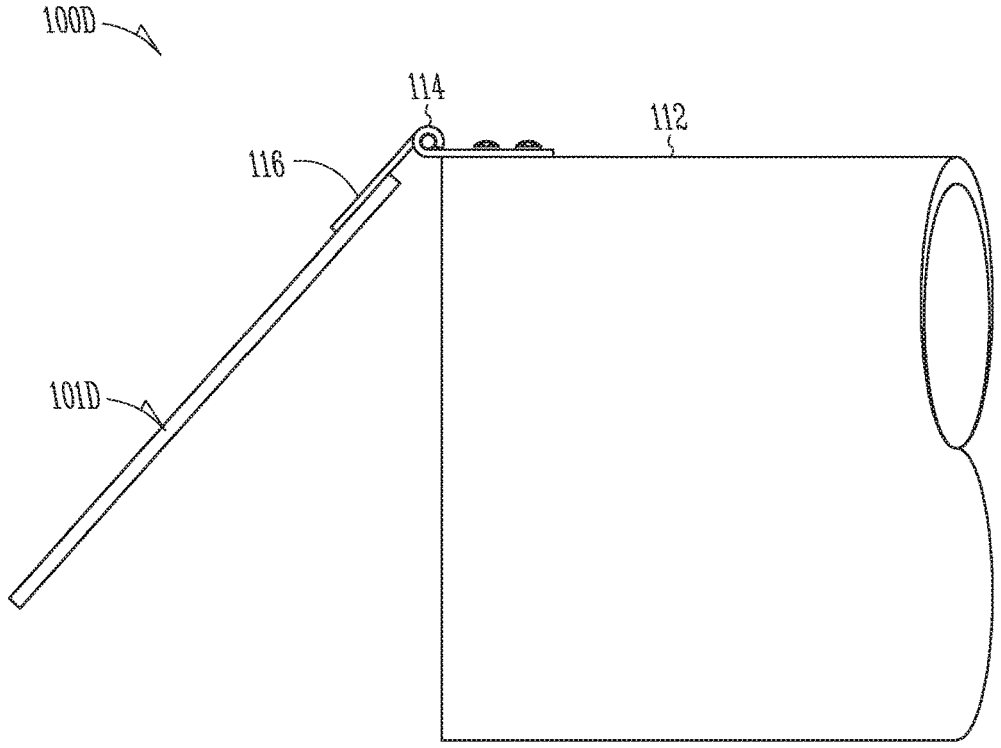
FIG. 15 illustrates a side view of the gate of FIG. 14 in an open position, in accordance with some embodiments of the present subject matter.

FIG. 10 illustrates an end view of the gate of FIG. 9 in a closed position in accordance with some embodiments of the present subject matter. FIG. 11 illustrates a side view of the gate of FIG. 9 in a closed position, in accordance with some embodiments of the present subject matter. FIG. 12 illustrates a side view of the gate of FIG. 9 in an open position, in accordance with some embodiments of the present subject matter;

FIG. 13 illustrates an end view of a gate 101D having a screen or mesh, in accordance with some embodiments of the present subject matter. The assembly 100D includes the gate 101D connected to the pipe 112 using hinge 116 and pivoting on rod 114. FIG. 14 illustrates a side view of the gate of FIG. 13 in a closed position, in accordance with some embodiments of the present subject matter. FIG. 15 illustrates a side view of the gate of FIG. 14 in an open position, in accordance with some embodiments of the present subject matter. The assembly 100D works much in the same way as the foregoing examples, with the exception that gate 101D includes a screen or mesh.

Figure 16:
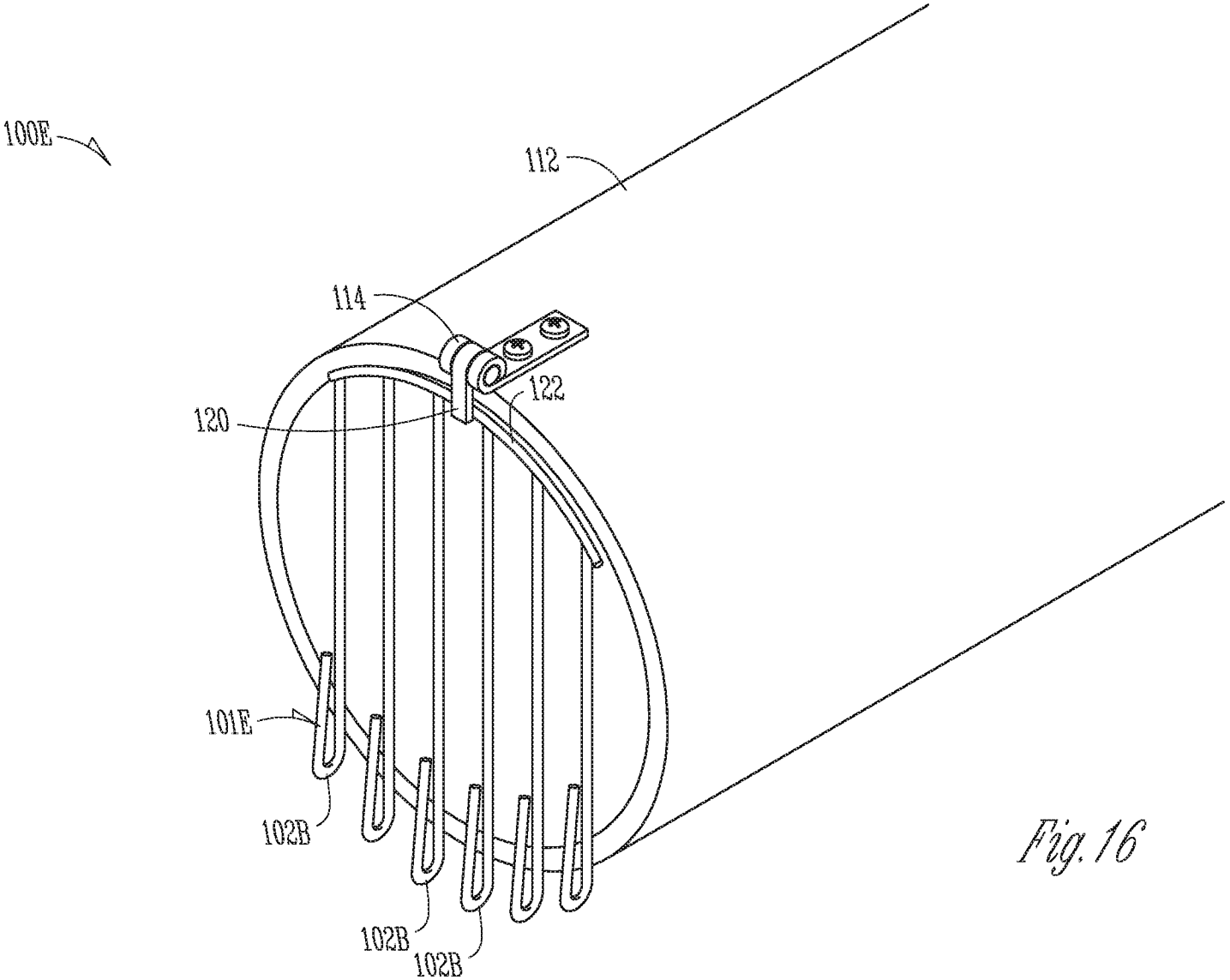
FIG. 16 illustrates a perspective view of a circular drain pipe having a gate mounted using a hinge and bar near the top of the gate and with additional weighting near the bottom of the gate, according to some embodiments of the present subject matter.

FIG. 16 illustrates a perspective view of a circular drain pipe 112 having a gate 101E mounted using a hinge 120 and bar 122 near the top of the gate 101E and with additional weighting near the bottom of the gate 101E, according to some embodiments of the present subject matter. Bar 122 can be used to provide a connection member and to connect the various bars 102B, instead of plate 118 (such as is demonstrated in FIG. 10). The use of a curved bar 122 facilitates closure of the gate 101E in assembly 100E. Gate 101E works in the same way as the aforementioned gates and may include additional structure, such as a bar across the lower portion of the gate 101E if needed to prevent pests from entering the pipe 112 in a closed state of the gate 101E. Thus, the design of gate 101E is provided to show that different mounting and connections may be employed without departing from the scope of the present subject matter.

Figure 17:
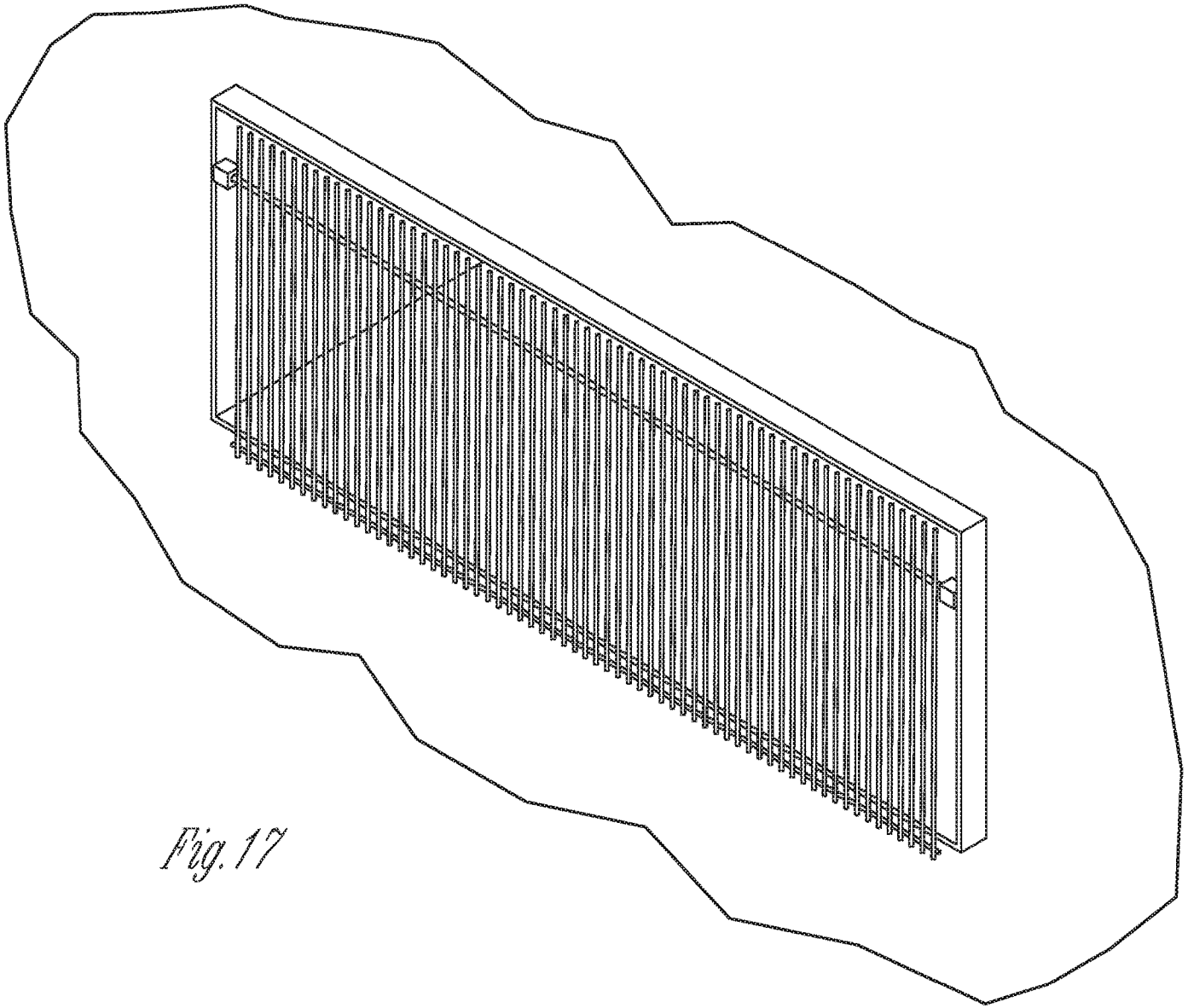
FIG. 17 illustrates a perspective view of a rectangular drain pipe having a gate mounted using two brackets, in accordance with some embodiments of the present subject matter.
Figure 18:
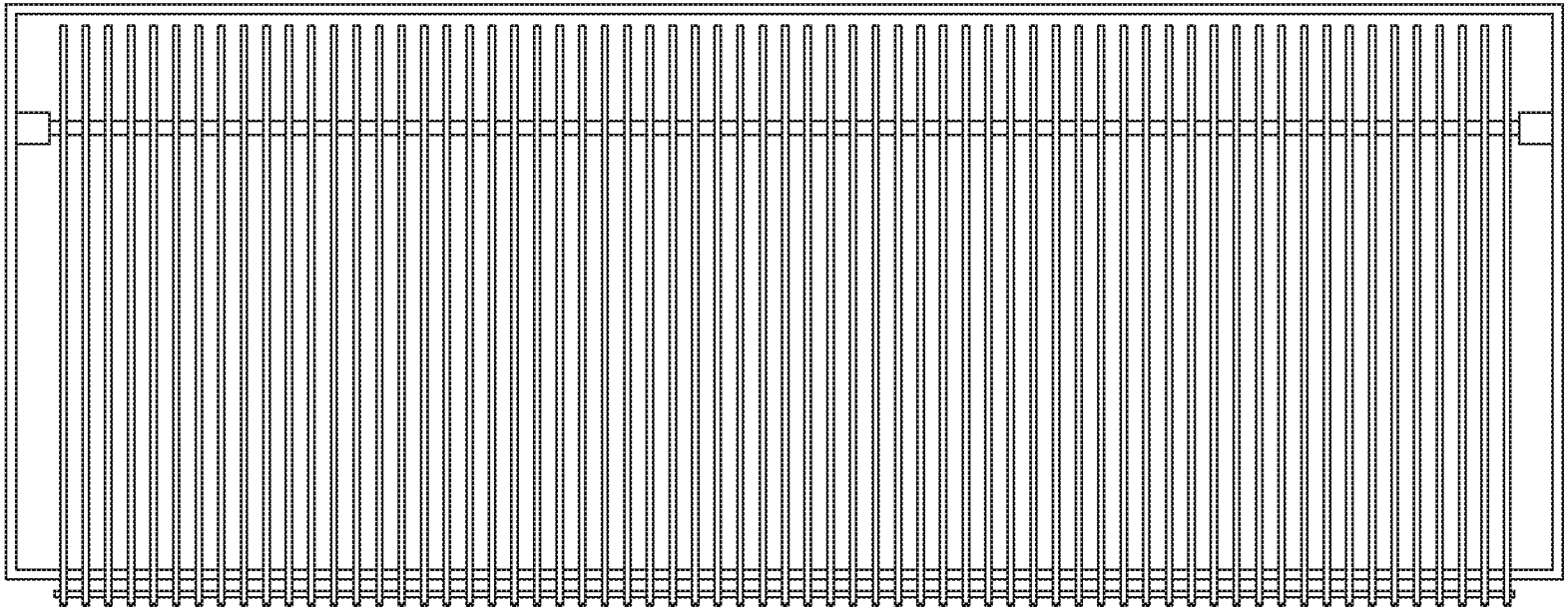
FIG. 18 illustrates an end view of the gate of FIG. 17 in a closed position, in accordance with some embodiments of the present subject matter.
Figure 19:
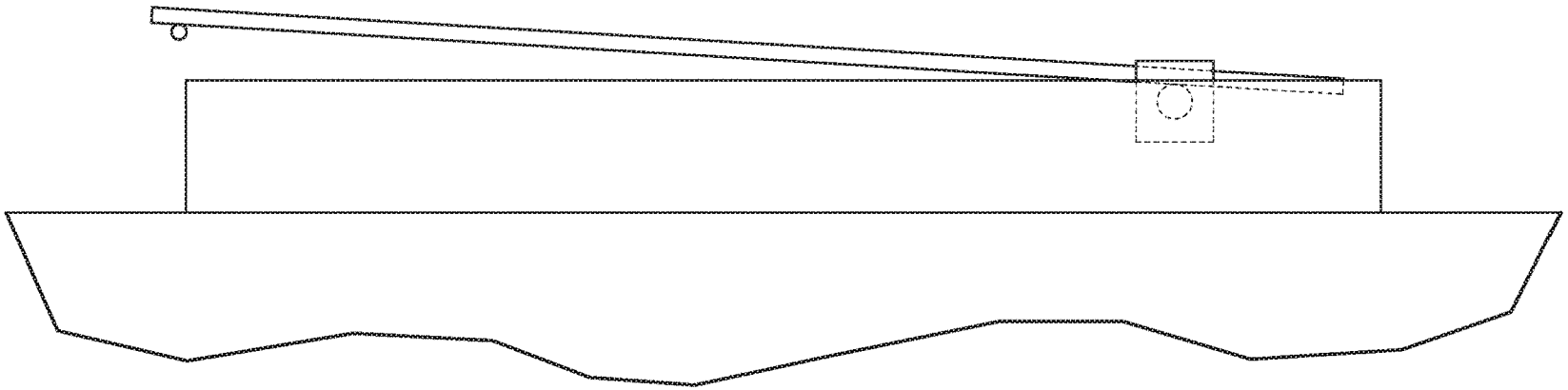
FIG. 19 illustrates a side view of the gate of FIG. 17 in a slightly open position, in accordance with some embodiments of the present subject matter.

FIG. 17 illustrates a perspective view of a rectangular drain pipe having a gate mounted using two brackets, in accordance with some embodiments of the present subject matter. Therefore, the present subject matter can be used in pipes and structures having different cross sections and openings. FIG. 18 illustrates an end view of the gate of FIG. 17 in a closed position, in accordance with some embodiments of the present subject matter; and FIG. 19 illustrates a side view of the gate of FIG. 17 in a slightly open position, in accordance with some embodiments of the present subject matter.

In various embodiments, the gate is configured to match the shape of the opening of the pipe or other open structure. In various embodiments, the gate is larger than the opening of the pipe or other structure. In various embodiments, the gate is larger than the opening of the pipe or other structure and the shape of the gate does not match the shape of the pipe or the opening of the other structure. Other gate variations are possible without departing from the scope of the present subject matter.

EXAMPLES

The present subject matter provides various examples of a pipe gate for a pipe, comprising: a gate shaped to substantially cover the opening of the pipe; and a hinge assembly mountable to an exterior surface of the pipe and connecting the gate to the pipe, the gate and hinge assembly configured to allow the gate to reside at a closed position to prevent animals from entering the pipe, and to allow the gate to swing open to allow liquid and debris to exit the pipe, the hinge assembly mounted to avoid catching the debris exiting the pipe. In various examples, the hinge assembly includes a bar configured to swivel using a pair of brackets on opposing sides of the pipe. In various examples, the pair of brackets are mounted closer to the top of the pipe than the bottom of the pipe to facilitate material flowing out of the pipe. In various examples, the hinge assembly includes a hinge connected at or near a top portion of the pipe. In various examples the gate further includes a mounting plate for connecting the gate to the hinge assembly.

In any of the foregoing examples, the gate may include a plurality of fingers mounted to a hinge member, the plurality of fingers spaced to prevent animals from entering into the pipe in a closed position, or the gate may include include a mesh connected to a hinge member, the mesh having a mesh spacing sized to prevent animals from entering the pipe in a closed position, among other things.

In any of the foregoing examples of the pipe gate, the hinge assembly may be mounted to an exterior of the pipe to avoid catching material flowing out of the pipe.

In any of the foregoing examples of the pipe gate, the gate may be weighted at its bottom portion to facilitate closure of the gate.

In any of the foregoing examples of the pipe gate, the gate may include a magnetic catch assembly at its bottom to facilitate closure of the gate.

In any of the foregoing examples of the pipe gate, the gate may include a friction catch at its bottom.

The pipe gate of any of the foregoing examples, may comprise metal, plastic, other materials, or combinations of these.

The pipe gate of any of the foregoing examples, may have a gate that is circular, square, rectangular, or elliptical in shape, or other shapes, whether symmetrical or asymmetrical. In various examples, the gate shape matches the shape of the opening of the pipe. In various examples, the gate shape does not match the shape of the opening of the pipe.

Various examples of the present subject matter provide a method of gating off a pipe, comprising: attaching one or more hinge assembly pieces to an exterior of a pipe, and attaching a gate to the one or more hinge assembly pieces, wherein the gate is attached to allow the gate to be in a normally closed state to prevent animals from entering the pipe, and open to allow material to exit the pipe, and wherein the hinge assembly pieces attached to not impede the passage of material from an exit of the pipe. In some examples, a pair of brackets is attached to an exterior surface of the pipe. In some examples a single hinge is attached near a top of the pipe.

The foregoing examples are not limiting or exclusive, and the scope of the present subject matter is to be determined by the specification as a whole, including the claims and drawings.

The above description includes references to the accompanying drawings, which form a part of the detailed description. The drawings show, by way of illustration, varying embodiments in which the invention can be practiced. The application also refers to "examples." Such examples can include elements in addition to those shown or described. The foregoing examples are not intended to be an exhaustive or exclusive list of examples and variations of the present subject matter.

The above description is intended to be illustrative, and not restrictive. For example, the above-described examples (or one or more aspects thereof) may be used in combination with each other. Other embodiments can be used, such as by one of ordinary skill in the art upon reviewing the above description.

The scope of the invention should be determined with reference to the appended claims, along with the full scope of equivalents to which such claims are entitled.

What is claimed is:

1. A pipe gate for a pipe, comprising:

a gate shaped to substantially cover an opening of the pipe; and a hinge assembly mountable to an exterior surface of the pipe and configured to connect the gate to the pipe, wherein the gate is further shaped to provide a bottom portion of the gate with additional weight to facilitate closure of the gate and includes a friction catch at the bottom portion, the friction catch configured to allow the gate to open as a result of liquid and debris exiting the pipe, wherein the gate and the hinge assembly are configured to allow the gate to reside at a closed position to prevent animals from entering the pipe and to allow the gate to swing open to allow the liquid and the debris to exit the pipe, and wherein the hinge assembly is mounted to avoid catching the debris exiting the pipe.

2. The pipe gate of claim 1, further comprising a pair of brackets on opposing sides of the pipe, and wherein the hinge assembly includes a bar configured to swivel using the pair of brackets.

3. The pipe gate of claim 2, wherein the pair of brackets is mounted closer to a top of the pipe than a bottom of the pipe to facilitate material flowing out of the pipe.

4. The pipe gate of claim 1, wherein the hinge assembly includes a hinge connected at or near a top portion of the pipe.

5. The pipe gate of claim 4, further including a mounting plate for connecting the gate to the hinge assembly.

6. The pipe gate of claim 4, wherein the gate comprises bars forming a grid and a curved bar connected between the bars forming the grid and the hinge.

7. The pipe gate of claim 1, wherein the gate includes a plurality of fingers mounted to a hinge member, the plurality of fingers spaced to prevent animals from entering the pipe when the gate is in a closed position.

8. The pipe gate of claim 1, wherein the gate includes a mesh connected to a hinge member, the mesh having a mesh spacing sized to prevent animals from entering the pipe when the gate is in a closed position.

9. The pipe gate of claim 1, wherein the hinge assembly is mounted to an exterior of the pipe to avoid catching material flowing out of the pipe.

10. The pipe gate of claim 1, wherein the gate includes a magnetic catch assembly at its bottom to facilitate closure of the gate.

11. The pipe gate of claim 1, wherein the gate comprises metal.

12. The pipe gate of claim 1, wherein the gate comprises plastic.

13. The pipe gate of claim 1, wherein the gate is circular in shape.

14. The pipe gate of claim 1, wherein the gate is rectangular in shape.

15. The pipe gate of claim 1, wherein the gate has a shape that matches a shape of the opening of the pipe.

16. The pipe gate of claim 1, wherein the gate has a shape that does not match a shape of the opening of the pipe.

17. The pipe gate of claim 1, wherein the gate comprises bars that are bent over at the bottom portion of the gate to provide the additional weight.

18. A method of gating off a pipe, comprising:

attaching one or more hinge assembly pieces to an exterior of the pipe;

attaching a gate to the one or more hinge assembly pieces;

facilitating closure of the gate by shaping the gate to weight the gate at a bottom portion of the gate; and providing the gate with a friction catch to facilitate catching of a bottom of the gate while allowing material and fluid to exit the pipe by opening the gate, wherein the gate is attached to allow the gate to be in a normally closed state to prevent animals from entering the pipe, and to be in an open state to allow the material to exit the pipe, and wherein the hinge assembly pieces are attached to not impede the passage of material from an exit of the pipe.

19. The method of claim 18, wherein the attaching one or more hinge assembly pieces includes attaching a pair of brackets to an exterior surface of the pipe.

20. The method of claim 18, wherein the attaching one or more hinge assembly pieces includes attaching a single hinge near a top of the pipe.

21. The method of claim 18, further comprising:

constructing the gate using bars; and bending the bars over at the bottom portion of the gate to weight the gate.

* * * * *